US011122366B2

(12) United States Patent
Reuter

(10) Patent No.: US 11,122,366 B2
(45) Date of Patent: Sep. 14, 2021

(54) METHOD AND APPARATUS FOR ATTENUATION OF AUDIO HOWLING

(71) Applicant: Continental Automotve Systems, Inc., Auburn Hills, MI (US)

(72) Inventor: Mike Reuter, Park Ridge, IL (US)

(73) Assignee: Continental Automotive Systems, Inc., Auburn Hills, MI (US)

( * ) Notice: Subject to any disclaimer, the term of this patent is extended or adjusted under 35 U.S.C. 154(b) by 0 days.

(21) Appl. No.: 16/782,744

(22) Filed: Feb. 5, 2020

(65) Prior Publication Data

US 2021/0243525 A1 Aug. 5, 2021

(51) Int. Cl.

| | |
|---|---|
| ***H04R 3/02*** | (2006.01) |
| ***G10L 21/0232*** | (2013.01) |
| ***H04R 1/02*** | (2006.01) |
| ***G10L 21/0216*** | (2013.01) |
| ***G10L 21/0208*** | (2013.01) |

(52) U.S. Cl.

CPC ..... *H04R 3/02* (2013.01); *G10L 21/0232* (2013.01); *H04R 1/025* (2013.01); *G10L 2021/02082* (2013.01); *G10L 2021/02163* (2013.01); *H04R 2499/13* (2013.01)

(58) Field of Classification Search

CPC .... G10L 21/0232; H03G 3/3005; H04R 3/04; H04R 25/45; H04B 3/20

See application file for complete search history.

(56) References Cited

U.S. PATENT DOCUMENTS

| | | | | |
|---|---|---|---|---|
| 5,768,398 | A | 6/1998 | Janse et al. | |
| 7,133,529 | B2 * | 11/2006 | Ura | H04R 3/02 381/66 |
| 9,330,650 | B2 | 5/2016 | Kobayashi et al. | |
| 2003/0012388 | A1 | 1/2003 | Ura | |
| 2004/0170284 | A1 * | 9/2004 | Janse et al. | H04R 3/12 381/66 |
| 2007/0172080 | A1 | 7/2007 | Janse et al. | |
| 2010/0278351 | A1 * | 11/2010 | Fozunbal | H04M 9/082 381/66 |
| 2018/0068672 | A1 | 3/2018 | Reuter | |
| 2018/0211681 | A1 | 7/2018 | Miyabe | |

FOREIGN PATENT DOCUMENTS

| | | | |
|---|---|---|---|
| EP | 2317778 | A2 | 5/2011 |
| JP | 2003032780 | A | 1/2003 |

OTHER PUBLICATIONS

Carlos Renato Calcada Nakagawa "Control of feedback for assistive listening devices", Thesis Paper, Schoo of Electrical and Computer Engineering, Jun. 2014.

Toon Van Waterschoot et al. "Fifty Years of Acoustic Feedback Control: State of the Art and Future challenges", Proceedings of the IEEE, vol. 99, No. 2, Feb. 2011, IEEE.

International Search Report and Written Opinion dated Apr. 20, 2021 from corresponding International Patent Application No. PCT/US2021/014993.

* cited by examiner

*Primary Examiner* — Yosef K Laekemariam

(57) ABSTRACT

Regions of the audio frequency spectrum that are most susceptible to howling are identified or determined. When detected, these approaches shape the frequency spectrum of the audio going to loudspeakers so that only those howling frequencies are suppressed.

18 Claims, 5 Drawing Sheets

METHOD AND APPARATUS FOR ATTENUATION OF AUDIO HOWLING

TECHNICAL FIELD

This application relates to eliminating or reducing howling in audio signals presented to listeners.

BACKGROUND OF THE INVENTION

In-car communication systems have seen increasing interest from manufacturers and customers. Typically, these systems include one or more microphones and speakers. Sometimes, a hands-free system is provided that allows communication from one zone in the vehicle to another zone in the vehicle. In one example, a system is configured so that the driver's speech from a hands-free microphone is routed to loudspeakers in the rear of the vehicle so the driver does not feel compelled to turn their head to speak to passengers in the rear of the vehicle during high noise conditions.

In these setups, audio howling sometimes occurs. More specifically, microphone/loudspeaker feedback might result in audible howling or ringing when the acoustic coupling is high enough. In these situations, a signal is received by the microphone, amplified, and passed out of the speaker. The speaker's sound can be picked up by the microphone, and the loop continues. This creates a "howling" noise that can be heard by listeners and this can be an unpleasant experience.

BRIEF DESCRIPTION OF THE DRAWINGS

For a more complete understanding of the disclosure, reference should be made to the following detailed description and accompanying drawings wherein.

Figure 1:
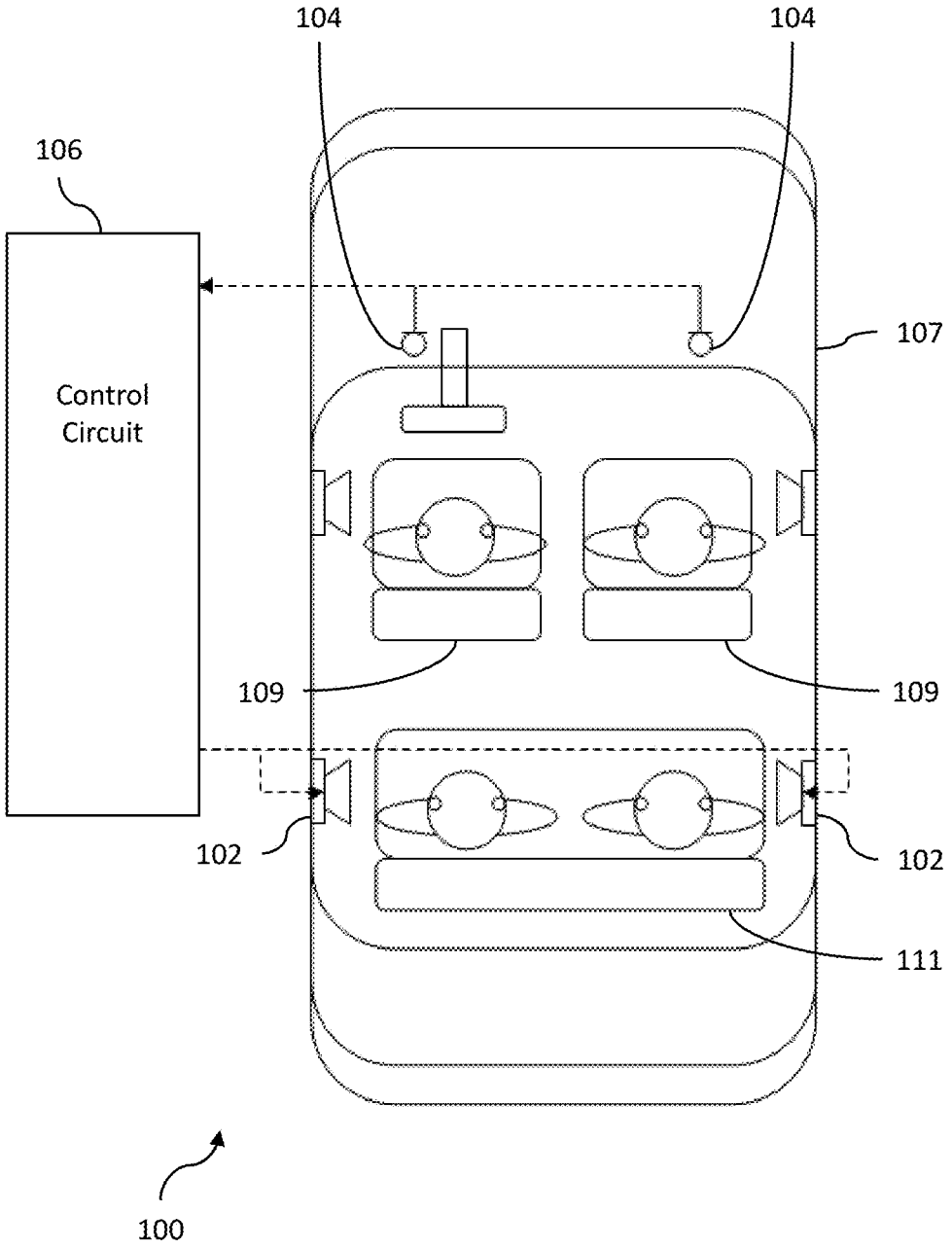
FIG. 1 comprises a diagram of a system for howling attenuation according to various embodiments of the present invention.

Skilled artisans will appreciate that elements in the figures are illustrated for simplicity and clarity. It will further be appreciated that certain actions and/or steps may be described or depicted in a particular order of occurrence while those skilled in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION

In the approaches described herein, regions of the audio frequency spectrum that are most susceptible to howling are identified or determined. When detected, these approaches shape the frequency spectrum of the audio sent to loudspeakers so that only those howling frequencies are suppressed.

The present approaches use an anti-howling mask or filter (sometimes called the "howling mask," "filter," or "masking filter" herein). In some aspects, this mask is derived from an adaptive filter and can be applied directly to the audio stream using existing equipment such as an existing noise suppression module.

Advantageously, the present approaches can use existing components (e.g., an acoustic echo canceller) as the acoustic channel estimator to detect howling conditions and to set the anti-howling masking filter. The approaches provided herein can also use an existing noise suppression module to implement the masking filtering. As a result, the present approaches minimize the additional computations needed within the system, only modestly increasing the computations performed within existing system components.

In aspects, an adaptive filter is used to model the cabin enclosure feedback system used in a vehicle. In one example, this filter is used as an echo canceller. These approaches analyze the filter weights in the frequency domain. All spectral weight components that exceed a magnitude of unity will supply gain to the feedback system and result in feedback ringing or howling. A masking filter is generated that inverts those frequencies and leaves the other frequencies unaltered. This filter is applied to the loudspeaker output. The resultant composite spectrum presented by the loudspeaker has the howling frequencies attenuated to unity magnitude with the other frequencies unchanged.

In examples, various approaches can be used to implement the masking filter. For example, an existing noise suppression module can be used. Noise suppression is typically frequency-based using an overlap-and-add method of filtering. In this case, the masking filter can be applied directly within the noise suppression module using the frequency domain masking spectrum. This particular implementation avoids an additional filtering operation.

In many of these embodiments, a system for attenuating howling at a speaker is provided. The system comprises an audio speaker, a microphone, and a control circuit. The control circuit is coupled to the audio speaker and the microphone.

The control circuit is configured to create an estimate of an echo path signal based upon an input to the audio speaker and an output of the microphone. The control circuit is further configured to dynamically generate an acoustic filter according to selected ones of a plurality of frequencies in the estimate of the echo path signal. Each of the selected ones of the plurality of frequencies result in audio howling at the audio speaker. The control circuit is further configured to convert an analog microphone signal received at the microphone to a digital microphone signal. The control circuit is configured to apply the digital microphone signal to the acoustic filter creating an attenuated digital signal, the attenuated digital signal including an attenuation of the echo path signal only at the selected ones of the plurality of frequencies. The control circuit is still further configured to convert the attenuated digital signal to an attenuated analog signal. The audio speaker renders the attenuated analog signal to a user.

In aspects, the audio speaker, control circuit, and microphone are disposed in a vehicle. In examples, the vehicle is a car, a truck, an aircraft, or a ship. Other locations and vehicle types are possible.

In other examples, the estimate of the echo path signal is created by subtracting the output of the microphone from the output of the acoustic filter, the subtraction creating a difference. In some aspects, the filter is configured so as to minimize the square of the difference.

In other aspects, noise attenuation is also applied to the digital microphone signal. In examples, the digital microphone signal is in the frequency domain and the analog microphone signal is in the time domain. In yet other examples, the microphone is a hands-free microphone.

In others of these embodiments, an approach for attenuating howling at a speaker is provided. An audio speaker, a microphone, and a control circuit are provided.

The control circuit creates an estimate of an echo path signal based upon an input to the audio speaker and an output of the microphone. The control circuit dynamically generates an acoustic filter according to selected ones of a plurality of frequencies in the estimate of the echo path signal. Each of the selected ones of the plurality of frequencies result in audio howling at the audio speaker. The control circuit converts an analog microphone signal received at the microphone to a digital microphone signal and applies the digital microphone signal to the acoustic filter creating an attenuated digital signal. The attenuated digital signal includes an attenuation of the echo path signal only at the selected ones of the plurality of frequencies. The control circuit converts the attenuated digital signal to an attenuated analog signal. The audio speaker renders the attenuated analog signal to a user.

Referring now to FIG. 1, a system 100 is configured to reduce and/or prevent audio howling. The system 100 comprises audio speakers 102, microphones 104, and a control circuit 106. The control circuit 106 is coupled to the audio speakers 102 and the microphones 104. In aspects, the audio speakers 102, control circuit 106, and microphones 104 are disposed in a vehicle 107. In examples, the vehicle 107 is a car, a truck, an aircraft, or a ship. Other locations and vehicle types are possible. The vehicle 107 includes front seats 109 and a back seat 111. Although, for drawing clarity, the control circuit 106 and connections between some system components are shown as being outside the vehicle 107, the control circuit 106 may be deployed in the vehicle, for example, as part of a vehicle control unit or system.

The components can be connected using various wired and/or wireless connections. In addition, the memory may be included in the system (e.g., at the control circuit) to store programmed instructions to implement the functions herein, or to temporarily or permanently store information (e.g., the masks) described herein.

The audio speakers 102 are any type of speaker used to produce audible sounds for human listeners. For example, the speakers 102 may be any type of speaker that are typically found in an automobile to present the conversations of occupants, music, or other audible sounds to listeners in the vehicle 107.

The microphones 104 are any type of device that receives sound energy and convert the sound energy into an electrical signal. In one example, the microphones 104 produce or create an analog electrical signal in the time domain from received sound energy. Various types of microphones are possible. In one example, the microphones 104 are hands-free microphones. Other examples of microphones are possible.

It will be appreciated that as used herein the term "control circuit" refers broadly to any microcontroller, computer, or processor-based device with processor, memory, and programmable input/output peripherals, which is generally designed to govern the operation of other components and devices. It is further understood to include common accompanying accessory devices, including memory, transceivers for communication with other components and devices, etc. These architectural options are well known and understood in the art and require no further description here. The control circuit 106 may be configured (for example, by using corresponding programming stored in a memory as will be well understood by those skilled in the art) to carry out one or more of the steps, actions, and/or functions described herein.

In the remainder of this discussion, one audio speaker 102 and one microphone 104 are assumed. However, as shown in FIG. 1, two speakers and two speakers can be used. In fact, it will be understood that any number of speakers and microphones can be utilized in the approaches described herein.

The control circuit 106 is configured to create an estimate of an echo path signal based upon an input to the audio speaker and an output of the microphone. The control circuit 106 is further configured to dynamically generate an acoustic filter according to selected ones of a plurality of frequencies in the estimate of the echo path signal. Each of the selected ones of the plurality of frequencies result in audio howling at the audio speaker 102. By "howling" and in examples, it is meant an audible screeching caused, at least in part, by feedback within the system. The control circuit 106 is further configured to convert an analog microphone signal received at the microphone 104 to a digital microphone signal. The control circuit 106 is configured to apply the digital microphone signal to the acoustic filter creating an attenuated digital signal, the attenuated digital signal including an attenuation of the echo path signal only at the selected ones of the plurality of frequencies. The control circuit 106 is still further configured to convert the attenuated digital signal to an attenuated analog signal. The audio speaker 102 renders the attenuated analog signal to a user.

In other examples, the estimate of the echo path signal is created by subtracting the output of the microphone 104 from the output of the acoustic filter, the subtraction creating a difference. In some aspects, the filter is configured so as to minimize the square of the difference.

In other aspects, noise attenuation is also applied to the digital microphone signal. In examples, the digital microphone signal is in the frequency domain and the analog microphone signal is in the time domain. The filter may be implemented as any combination of hardware and/or software. In examples, mathematical equations implemented by computer software are used to implement the filter. It will also be appreciated that the filter dynamically changes over time and this represents a physical change in the system.

Figure 2:
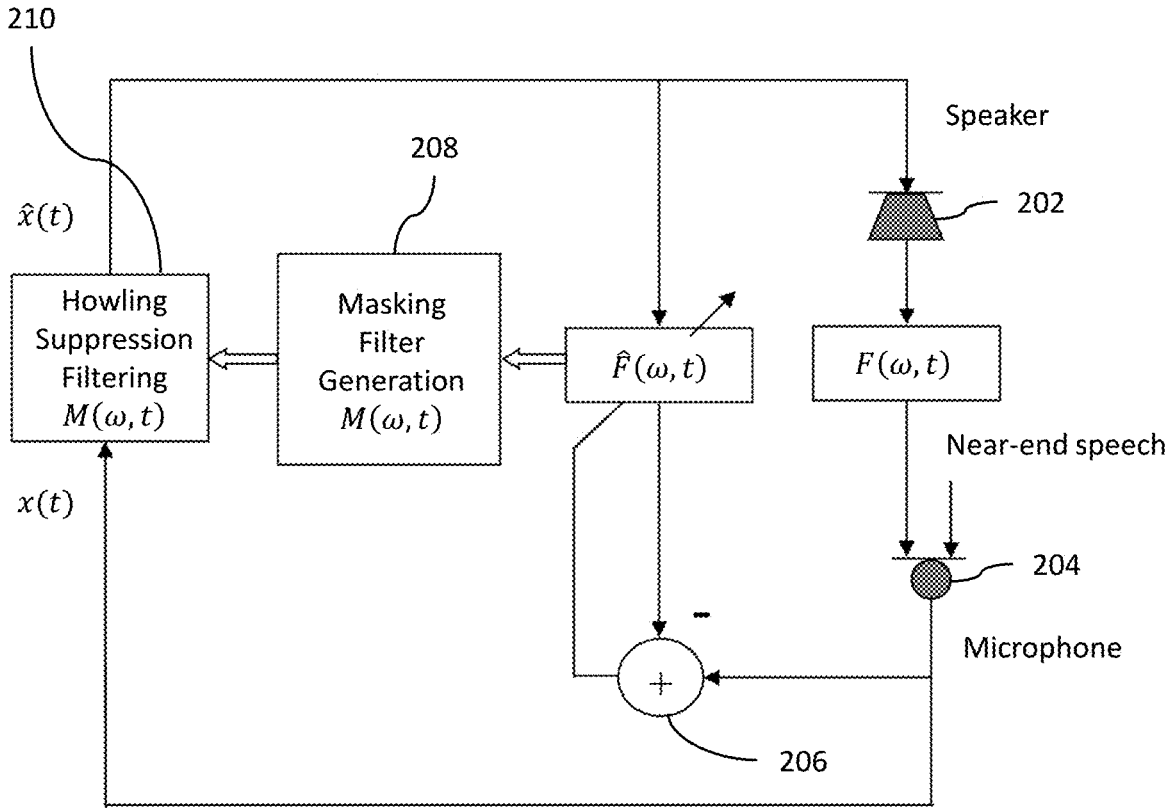
FIG. 2 comprises a diagram of an approach for howling attenuation according to various embodiments of the present invention.

Referring now to FIG. 2, other aspects of the present approaches are described. A speaker 202 produces an echo $F(w,t)$. It will be appreciated that "w" and "f" are used interchangeably herein and represent frequency. A microphone 204 receives near end speech and the echo.

At an adder 206, the output of an estimate of echo path $\hat{F}(f,t)$ filter is subtracted from the incoming signal from the microphone. The channel estimate $\hat{F}(f,t)$ is generated by subtracting the output of the microphone from the output of the filter $\hat{F}(f,t)$ and finding the value $\hat{F}(f,t)$ that minimizes the square of this difference. By minimizing the square of this difference, the "mean square error" estimate of the channel frequency response F(f,t) is generated. This "mean square error" channel estimate can be generated by various methods known to those skilled in the art.

At step 208, a mask or filter is generated. The mask M(f,t) is defined by $M(f,t)\times\hat{F}(f,t)=1$ for all frequencies f where $\hat{F}(f,t)>1$ and $M(f,t)\times\hat{F}(f,t)=\hat{F}(f,t)$ for all frequencies f where $\hat{F}(f,t)\leq 1$.

At step 210, the mask only attenuates the channel spectrum $\hat{F}(f,t)$ at frequencies where $\hat{F}(f,t)$ is greater than 1. For all other frequencies the channel spectrum is unchanged. The mask M(f,t) is generated by $M(f,t)=1/\hat{F}(f,t)$ for all frequencies f where $\hat{F}(f,t)>1$ and $M(f,t)=1$ for all frequencies f where $\hat{F}(f,t)\leq 1$.

Figure 3:
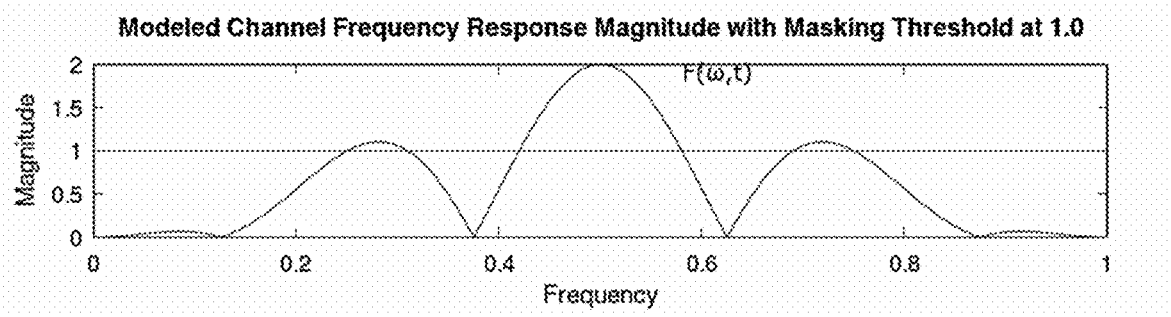
FIG. 3 comprises a diagram illustrating aspects of the operation of the approaches described herein according to various embodiments of the present invention.
Figure 4:
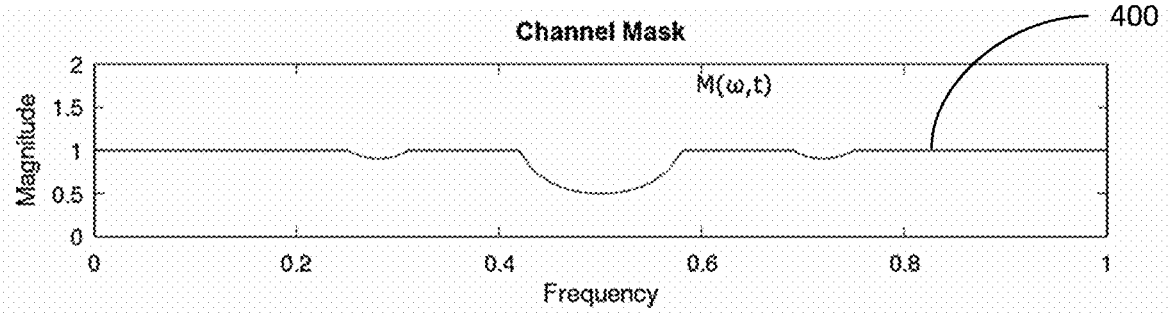
FIG. 4 comprises a diagram illustrating aspects of the operation of the approaches described herein according to various embodiments of the present invention.
Figure 5:
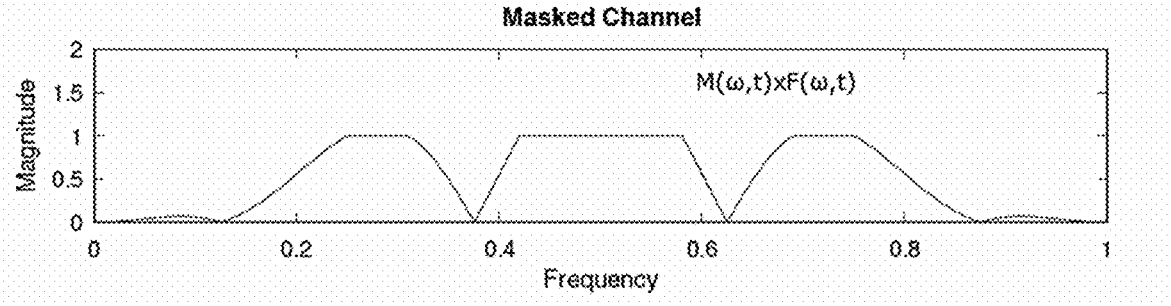
FIG. 5 comprises a diagram illustrating aspects of the operation of the approaches described herein according to various embodiments of the present invention.

Referring now to FIG. 3, FIG. 4, and FIG. 5, examples of the application of these approaches are described.

FIG. 3 shows one example of a modeled channel frequency response F(w,t) or F(f,t). The plot shown in FIG. 3 represents the echo signal with particular magnitudes (or weights) at particular frequencies. Signal magnitude is on the y-axis and frequency is on the x-axis.

All weight components that exceed a magnitude of unity will result in feedback ringing or howling. As described herein, a masking filter is generated that inverts those frequencies and leaves the other frequencies unaltered. This filter is applied to the loudspeaker output. The resultant composite spectrum has the howling frequencies attenuated to unity magnitude with the other frequencies unchanged.

As shown in this figure, a threshold of 1 is selected to attenuate. In other words, any component above magnitude 1 will be attenuated.

FIG. 4 shows an example of a mask or filter 400. Signal magnitude is shown on the y-axis and frequency is shown on the x-axis. As shown in this figure, the mask 400 has negative quantities in the regions of the modeled frequency response which are above one (in magnitude). As mentioned, the mask 400 can be implemented as any combination of hardware or software. For example, one or more mathematical equations may be implemented in computer software and executed by a control circuit. These equations represent the mask 400 shown in FIG. 4.

FIG. 5 shows the result (a composite spectrum showing multiple frequencies) of applying the mask to the channel frequency response. It can be seen that for frequencies having weights with magnitudes above 1, the frequency response is reduced to 1 by the application of the mask 400. At these frequencies, the mask attenuates the signal magnitude. It can also be seen that at some other frequencies, the mask 400 is 1 and no subtraction occurs.

Figure 6:
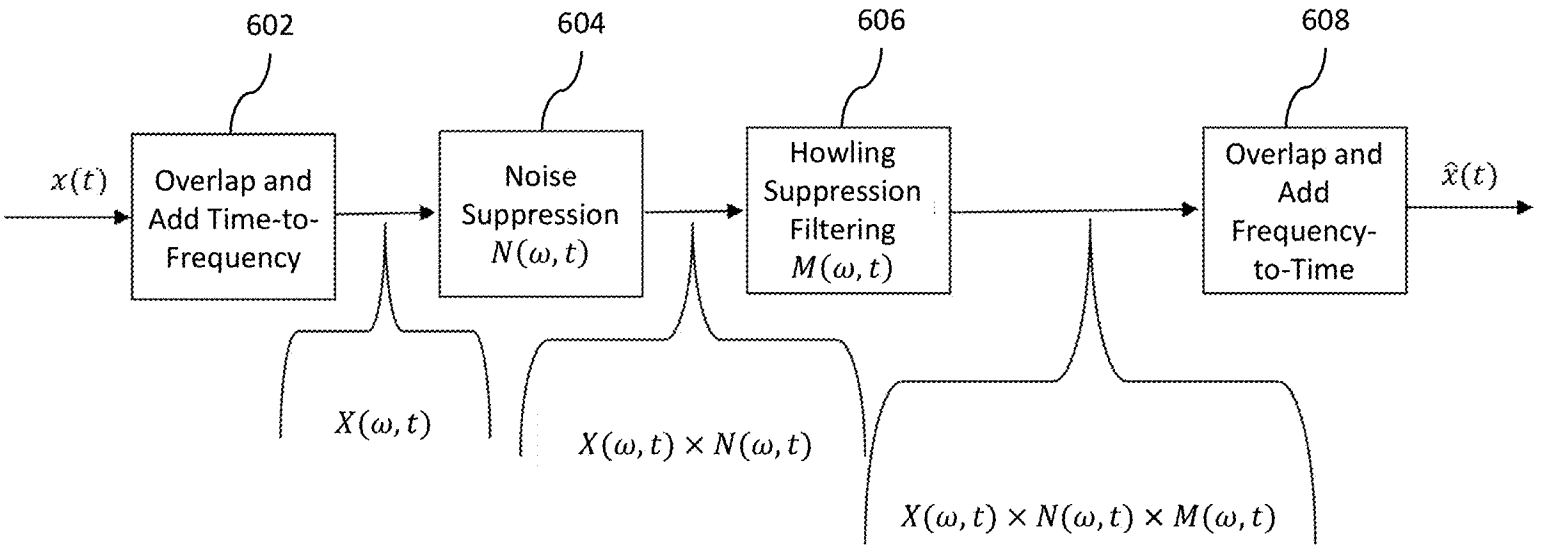
FIG. 6 comprises a flowchart illustrating aspects of the operation of the approaches described herein according to various embodiments of the present invention.

Referring now to FIG. 6, an example of the application of these approaches is described. At step 602 the input audio signal x(t) is received. At step 602, overlap and conversion to the frequency domain of the input audio signal x(t) occurs. In this step, x(t) is broken up into segments, smoothed in time, overlapped with neighboring segments and converted to the frequency domain. This produces the signal X(w,T). At step 604, this signal has its noise suppressed. This results in $X(w,T)\times N(w,t)$. By noise suppression, it is meant the attenuation of noise in the frequency domain while maintaining speech intelligibility.

At step 606, howling suppression occurs as described herein. This produces the signal $X(w,T)\times N(w,t)\times M(w,t)$. This is converted to the time domain at step 608. This signal can be presented to listeners by a loudspeaker.

Figure 7:
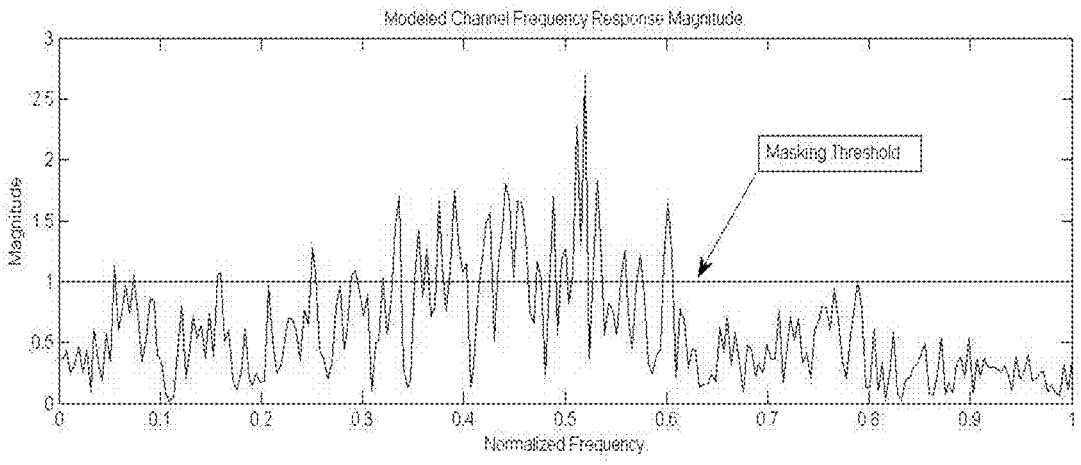
FIG. 7 comprises diagram illustrating aspects of the operation of the approaches described herein according to various embodiments of the present invention.

Referring now to FIG. 7, another example of a modeled channel frequency response F(w,t) is described. This represents the echo signal with particular magnitudes (weights) at particular frequencies. Signal magnitude is on the y-axis and frequency is on the x-axis.

All weight components that exceed a magnitude of unity will result in feedback ringing or howling. As shown in this figure, a threshold of 1 is selected to attenuate. In other words, anything above magnitude 1 will be attenuated.

Figure 8:
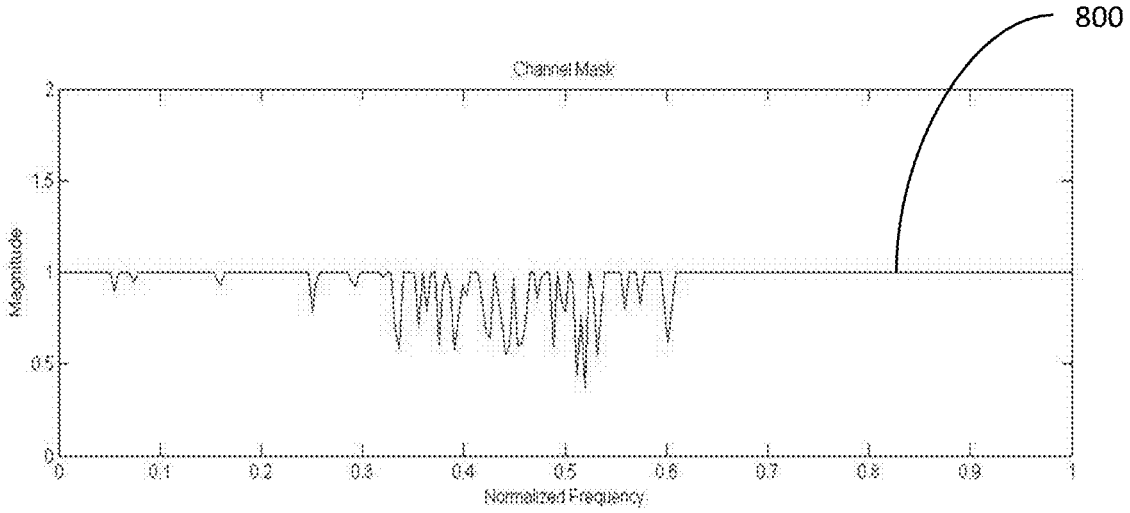
FIG. 8 comprises diagram illustrating aspects of the operation of the approaches described herein according to various embodiments of the present invention.

Referring now to FIG. 8, another example of a masking filter 800 is described. This particular masking filter 800 is applicable to the modeled channel frequency response F(w,t) of FIG. 7. This masking filter 800 is generated and inverts those frequencies and leaves the other frequencies unaltered. The masking filter 800 may be implemented as any combination of hardware and software. This filter is applied to the loudspeaker output. The resultant composite spectrum has the howling frequencies attenuated to unity magnitude with the other frequencies unchanged. The composite spectrum is presented to listeners, for example, at a speaker. Consequently, it can be seen that the present approaches attenuate only howling-related frequencies, leaving all other frequencies in a spectrum of frequencies unaltered.

It should be understood that any of the devices described herein (e.g., the control circuits, the controllers, the vehicle control units, the noise suppression modules, any receivers, any transmitters, any sensors, any presentation or display devices, or any other electronic devices) may use a computing device to implement various functionality and operation of these devices. In terms of hardware architecture, such a computing device can include but is not limited to a control circuit, processor, a memory, and one or more input and/or output (I/O) device interface(s) that are communicatively coupled via a local interface. The local interface can include, for example but not limited to, one or more buses and/or other wired or wireless connections. The processor may be a hardware device for executing software, particularly software stored in memory. The processor can be a custom made or commercially available processor, a central processing unit (CPU), an auxiliary processor among several processors associated with the computing device, a semiconductor based microprocessor (in the form of a microchip or chip set) or generally any device for executing software instructions.

The memory devices described herein can include any one or combination of volatile memory elements (e.g., random access memory (RAM), such as dynamic RAM (DRAM), static RAM (SRAM), synchronous dynamic RAM (SDRAM), video RAM (VRAM), and so forth)) and/or nonvolatile memory elements (e.g., read only memory (ROM), hard drive, tape, CD-ROM, and so forth). Moreover, the memory may incorporate electronic, magnetic, optical, and/or other types of storage media. The memory can also have a distributed architecture, where various components are situated remotely from one another, but can be accessed by the processor.

The software in any of the memory devices described herein may include one or more separate programs, each of which includes an ordered listing of executable instructions for implementing the functions described herein. When constructed as a source program, the program is translated via a compiler, assembler, interpreter, or the like, which may or may not be included within the memory.

It will be appreciated that any of the approaches described herein can be implemented at least in part as computer instructions stored on a computer media (e.g., a computer memory as described above) and these instructions can be executed on a processing device such as a microprocessor. However, these approaches can be implemented as any combination of electronic hardware and/or software.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. A system for attenuating howling at a speaker, the system comprising:

an audio speaker;

a microphone;

a control circuit coupled to the audio speaker and the microphone, the control circuit configured to:

create an estimate of an echo path signal based upon an input to the audio speaker and an output of the microphone;

dynamically generate an acoustic filter according to selected ones of a plurality of frequencies in the estimate of the echo path signal, wherein each of the selected ones of the plurality of frequencies have respective modeled channel frequency response magnitudes greater than unity and corresponding respective channel mask magnitude values that are correspondingly less than unity;

convert an analog microphone signal received at the microphone to a digital microphone signal;

apply the digital microphone signal to the acoustic filter creating an attenuated digital signal, the attenuated digital signal including an attenuation of the echo path signal by the corresponding respective channel mask magnitude values only at the selected ones of the plurality of frequencies thereby preventing audio howling at the selected ones of the plurality of frequencies;

convert the attenuated digital signal to an attenuated analog signal;

wherein the audio speaker renders the attenuated analog signal to a user.

2. The system of claim 1, wherein the audio speaker, control circuit, and microphone are disposed in a vehicle.

3. The system of claim 1, wherein the vehicle is a car, a truck, an aircraft, or a ship.

4. The system of claim 1, wherein the estimate of the echo path signal is created by subtracting the output of the microphone from the output of the acoustic filter, the subtraction creating a difference.

5. The system of claim 4, wherein the filter is configured so as to minimize the square of the difference.

6. The system of claim 1, wherein noise attenuation is also applied to the digital microphone signal.

7. The system of claim 1, wherein the digital microphone signal is in the frequency domain and the analog microphone signal is in the time domain.

8. The system of claim 1, wherein the microphone is a hands-free microphone.

9. A method for attenuating howling at a speaker, the method comprising:

providing an audio speaker, a microphone, and a control circuit;

by the control circuit:

creating an estimate of an echo path signal based upon an input to the audio speaker and an output of the microphone;

dynamically generating an acoustic filter according to selected ones of a plurality of frequencies in the estimate of the echo path signal, wherein each of the selected ones of the plurality of frequencies have respective modeled channel frequency response magnitudes greater than unity and corresponding respective channel mask magnitude values that are correspondingly less than unity;

converting an analog microphone signal received at the microphone to a digital microphone signal;

applying the digital microphone signal to the acoustic filter creating an attenuated digital signal, the attenuated digital signal including an attenuation of the echo path signal by the corresponding respective channel mask magnitude values only at the selected ones of the plurality of frequencies thereby preventing audio howling at the selected ones of the plurality of frequencies;

converting the attenuated digital signal to an attenuated analog signal;

wherein the audio speaker renders the attenuated analog signal to a user.

10. The method of claim 9, wherein the audio speaker, control circuit, and microphone are disposed in a vehicle.

11. The method of claim 9, wherein the vehicle is a car, a truck, an aircraft, or a ship.

12. The method of claim 9, wherein the estimate of the echo path signal is created by subtracting the output of the microphone from the output of the acoustic filter, the subtraction creating a difference.

13. The method of claim 12, wherein the filter is configured so as to minimize the square of the difference.

14. The method of claim 9, wherein noise attenuation is also applied to the digital microphone signal.

15. The method of claim 9, wherein the digital microphone signal is in the frequency domain and the analog microphone signal is in the time domain.

16. The method of claim 9, wherein the microphone is a hands-free microphone.

17. The system of claim 1, wherein the corresponding respective channel mask magnitude values are inversely proportional to the respective modeled channel frequency response magnitudes.

18. The method of claim 9, wherein the corresponding respective channel mask magnitude values are inversely proportional to the respective modeled channel frequency response magnitudes.

* * * * *